US007322209B2

(12) United States Patent
Hwang et al.

(10) Patent No.: US 7,322,209 B2
(45) Date of Patent: Jan. 29, 2008

(54) REFRIGERATOR

(75) Inventors: Ji Sick Hwang, Gwangju (KR); Hyun Jong Kim, Gwangju (KR); Myung Wouk Kim, Gwangju (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 358 days.

(21) Appl. No.: 11/077,115

(22) Filed: Mar. 11, 2005

(65) Prior Publication Data

US 2005/0217308 A1 Oct. 6, 2005

Related U.S. Application Data

(60) Provisional application No. 60/557,389, filed on Mar. 30, 2004, provisional application No. 60/557,397, filed on Mar. 30, 2004.

(30) Foreign Application Priority Data

Mar. 30, 2004 (KR) ..... 10-2004-0021497
Mar. 31, 2004 (KR) ..... 10-2004-0022299

(51) Int. Cl.
*F25D 11/00* (2006.01)
*F25D 19/00* (2006.01)
*F25D 21/14* (2006.01)
*F25B 39/04* (2006.01)

(52) U.S. Cl. ..... 62/449; 62/440; 62/443; 312/407.1; 312/120

(58) Field of Classification Search ..... 62/440, 62/448; 439/31; 312/401, 405, 407.1, 120; 220/780
See application file for complete search history.

(56) References Cited

U.S. PATENT DOCUMENTS 2,753,695 A * 7/1956 Maranto ..... 62/448
3,712,078 A * 1/1973 Maynard et al. ..... 62/448
4,070,728 A 1/1978 Herman
4,646,528 A * 3/1987 Marcade et al. ..... 62/127
4,970,874 A * 11/1990 Solak et al. ..... 62/258
5,284,023 A * 2/1994 Silva et al. ..... 62/77
5,787,724 A * 8/1998 Pohl et al. ..... 62/389
6,279,774 B1 * 8/2001 Clute et al. ..... 220/792
6,789,392 B1 * 9/2004 Miller et al. ..... 62/130
6,981,591 B2 * 1/2006 Logan ..... 206/451

FOREIGN PATENT DOCUMENTS

JP 09-061046 3/1997

(Continued)

OTHER PUBLICATIONS

People's Republic of China Office Action dated Mar. 16, 2007.

(Continued)

*Primary Examiner*—Terrell L. McKinnon
*Assistant Examiner*—Dharam Bhatt
(74) *Attorney, Agent, or Firm*—Sughrue Mion, Pllc.

(57) ABSTRACT

A refrigerator, and more particularly, a refrigerator equipped with a machinery chamber door, which is provided to open or close a machinery chamber formed at an upper portion of a body of the refrigerator. The refrigerator includes a body with a storage chamber, and with a machinery chamber provided at an upper portion of the body such that the machinery chamber is partitioned from the storage chamber, an opening portion provided at one side of the machinery chamber, a machinery chamber door hingably coupled to the opening portion such that the machinery chamber door can be rotated up and down to open or close the machinery chamber, a recess member provided to the machinery chamber door and defined with a recess, and an insertion member inserted into the recess and fixed to the body.

15 Claims, 6 Drawing Sheets

FOREIGN PATENT DOCUMENTS

| | | | |
|---|---|---|---|
| JP | 09-229548 | | 9/1997 |
| JP | 09-303943 | | 11/1997 |
| JP | 11-257837 | | 9/1999 |
| JP | 11-304355 | | 11/1999 |
| JP | 2001-272162 | | 10/2001 |
| JP | 2003-121063 | | 4/2003 |
| KR | 20-1992-0008346 | | 11/1992 |
| KR | 20-1998-066051 | | 12/1998 |
| KR | 10-1999-0042664 | | 6/1999 |
| KR | 20-1999-0030413 | | 7/1999 |
| KR | 00234111 | B1 | 9/1999 |
| KR | 20-2000-0015520 | | 8/2000 |
| KR | 20-0279648 | | 6/2002 |
| KR | 20-0319651 | | 7/2003 |
| KR | 20-0336420 | | 12/2003 |
| KR | 20-0336423 | | 12/2003 |
| KR | 10-2004-00002170 | A | 1/2004 |

OTHER PUBLICATIONS

English language Abstract of KR Registration No. 20-0300286, published Jan. 14, 2003 (Application No. 20-2002-0027790 filed Sep. 16, 2002).

English language Abstract of KR Registration No. 20-0343090, published May 31, 2004 (Application No. 20-1998-0018582 filed Sep. 29, 1998).

* cited by examiner

REFRIGERATOR

CROSS-REFERENCE TO RELATED APPLICATIONS

This application claims the benefit of Korean Patent Application Nos. 2004-21497, filed on Mar. 30, 2004 and 2004-22299, filed on Mar. 31, 2004 in the Korean Intellectual Property Office, and U.S. Provisional Application Nos. 60/557,389 filed on Mar. 30, 2004 and 60/557,397 filed on Mar. 30, 2004 in the United States Patent and Trademark Office, the disclosures of which are incorporated herein by reference.

BACKGROUND OF THE INVENTION

1. Field of the Invention

The present invention relates to a refrigerator, and more particularly, to a refrigerator equipped with a machinery chamber door, which is provided to open or close a machinery chamber formed at an upper portion of a body of the refrigerator.

2. Description of the Related Art

Generally, refrigerators are adapted to store various foods at a low temperature in a fresh state for a long time in a storage chamber by supplying cold air generated from an evaporator of a cooling cycle to the storage chamber. The refrigerator has an outer appearance defined by a body, of which an inner space is partitioned to define the storage chamber for storing frozen or refrigerated foods, and a machinery chamber equipped with a compressor, a condenser, a control box, and the like. The body defined with the storage chamber is equipped with a door hingably coupled to the front side of the body such that the door can be rotated right and left in order to open or close the storage chamber.

Further, in order to enhance space utility of the storage chamber, some conventional refrigerators are provided at an upper portion of the body with the machinery chamber, which is formed at the front side of the machinery chamber with an opening portion, and with a machinery chamber door hingably coupled to the opening portion such that the machinery chamber door can be rotated up and down for opening or closing the machinery chamber.

Further, in order to enhance convenience, there has been developed a refrigerator having a door equipped with an electrical component chamber, which includes an operating portion for controlling the overall operation of the refrigerator after receiving an operating signal from the user. Meanwhile, in order to define the electrical component chamber inside the door, an electric wire for electrically connecting the machinery chamber to the electrical component chamber in the door is required, and for this purpose, the electric wire is forced to pass through the opening portion of the machinery chamber and a hinge part, by which the door and the body are coupled each other.

However, since the conventional refrigerator has the electric wire passed through the door through the opening portion of the refrigerator, there is a problem in that when the machinery chamber door is opened or closed, there can occur interference between the electric wire and the machinery chamber door.

Moreover, since the conventional refrigerator has the structure wherein the machinery chamber door is hingably coupled to the opening portion to simply rotate up and down at the opening portion without a separate locking means, there is a problem in that the machinery chamber door can be opened or closed unintentionally due to an impact applied to the body when transporting the refrigerator or due to a vibration during operation of the compressor or the like, thereby causing noise.

SUMMARY OF THE INVENTION

The present invention addresses the problems involved with the above mentioned conventional refrigerator. One aspect of the present invention is to provide a refrigerator adapted such that an electric wire extending from the inside of a machinery chamber to the inside of a door for a body of the refrigerator is prevented from interfering with a machinery chamber door or from being damaged by the machinery chamber door, thereby protecting the wiring, and ensuring that the machinery chamber door is freely rotated.

Further, it is another aspect of the present invention to provide a refrigerator, in which the machinery chamber door, formed at an upper portion of the body of the refrigerator, for opening or closing the machinery chamber, is hingably coupled to an opening portion of the machinery chamber, such that the machinery chamber door can be maintained in a locked state, when necessary, without being opened, thereby preventing noise due to opening or closing of the machinery chamber door when transporting the refrigerator or the like.

Consistent with these aspects, these aspects are accomplished by providing a refrigerator comprising: a body with a storage chamber, and with a machinery chamber provided at an upper portion of the body such that the machinery chamber is partitioned from the storage chamber; an opening portion provided at one side of the machinery chamber; a machinery chamber door hingably coupled to the opening portion such that the machinery chamber door can be rotated up and down to open or close the machinery chamber; a recess member provided on the machinery chamber door and comprising a recess; and an insertion member inserted into the recess and fixed to the body.

The recess member and the insertion member may act as a locking device provided for preventing the machinery chamber from being opened.

The insertion member may be provided to support the machinery chamber door rotated toward the opening portion, and the recess member may be provided to the machinery chamber door such that the recess member is detachably engaged to the insertion member by pressing the machinery chamber door to the opening portion or to an opposite side of the opening portion.

The refrigerator may further comprise a door hingably coupled at a front side of the storage chamber to the body such that the door can be rotated right and left to open or close the storage chamber; an operating panel and a control box provided on an outer surface of the door and inside of the machinery chamber, respectively; an electric wire connected between the operating panel and the control box such that the electric wire can extend from inside of the door through an upper end of the door to the inside of the machinery chamber; and a hollow rod-shaped hinge shaft member joined to the upper end of the door while being provided such that the hinge shaft member is rotatably fitted in a hinge hole of a hinge bracket coupled to the body and the electric wire can be passed through the hinge shaft member; wherein the opening portion is situated at a front side of the machinery chamber, and the insertion member comprises an upper end of the hinge shaft member.

The insertion member may have a circular cross-sectional shape, and the recess member may have a barrel-shaped opening such that a lower end of the recess member can pass through one side of the insertion member for fitting the recess member to the insertion member via one side of the insertion member, while having an inner surface structured such that with the recess member fitted to the insertion member, the recess member can hold the insertion member while surrounding at least half of an outer surface of the insertion member in a circumferential direction.

The recess member may be made of an elastic material.

The recess member may have a side opening portion situated at one side of the recess member to which the insertion member is inserted, and a lower end opening portion situated at a lower end of the recess member, and the recess member may be made of an elastic material. The side opening portion may be widened while the insertion member is engaged to or disengaged from the recess member, and then narrowed to an initial state after the insertion member is engaged to or disengaged from the recess member.

The recess member may be made by extrusion molding, and fixed to a rear side of the machinery chamber door at a position corresponding to a position of the insertion member.

The recess member may have an upper end closed and spaced apart from an upper end of the insertion member.

Consistent with these aspects, an exemplary embodiment of the present invention provides a refrigerator comprising: a body with a storage chamber, and with a machinery chamber having an opening portion formed at one side of the machinery chamber; a door, equipped with an electrical component chamber, for opening or closing the storage chamber; an electric wire extending from the inside of the machinery chamber to the electrical component chamber through the opening portion of the machinery chamber; and a machinery chamber door with an electric wire avoidance portion comprising a recess member for preventing interference with the electric wire and an insertion member fitted to the recess member, such that the machinery chamber door opens and closes the opening portion of the machinery chamber.

The door may be hingably coupled to the body by a hinge part, and the electric wire may be fixed by the hinge part.

The hinge part may comprise a hollow hinge shaft member, such that the electric wire passes through the hinge shaft member.

The refrigerator may further comprise an electric wire protection member closely contacting while surrounding the electric wire avoidance portion when the machinery chamber door is closed.

The refrigerator may further comprise a control box provided in the machinery chamber, and electrically connected to the electrical component chamber by the electric wire.

The refrigerator may further comprise an operating panel provided in the door, and electrically connected to the electrical component chamber in order to receive an operating signal input by a user.

The machinery chamber door may comprise: a front panel made of stainless steel; a rear panel coupled to the front panel; and a reinforcing member provided between the front panel and the rear panel for preventing the front panel from being deformed.

BRIEF DESCRIPTION OF THE DRAWINGS

These and/or other aspects and advantages of the invention will become apparent and more readily appreciated from the following description of the exemplary embodiments, taken in conjunction with the accompanying drawings, in which.

DETAILED DESCRIPTION OF THE EXEMPLARY EMBODIMENTS

Figure 1:
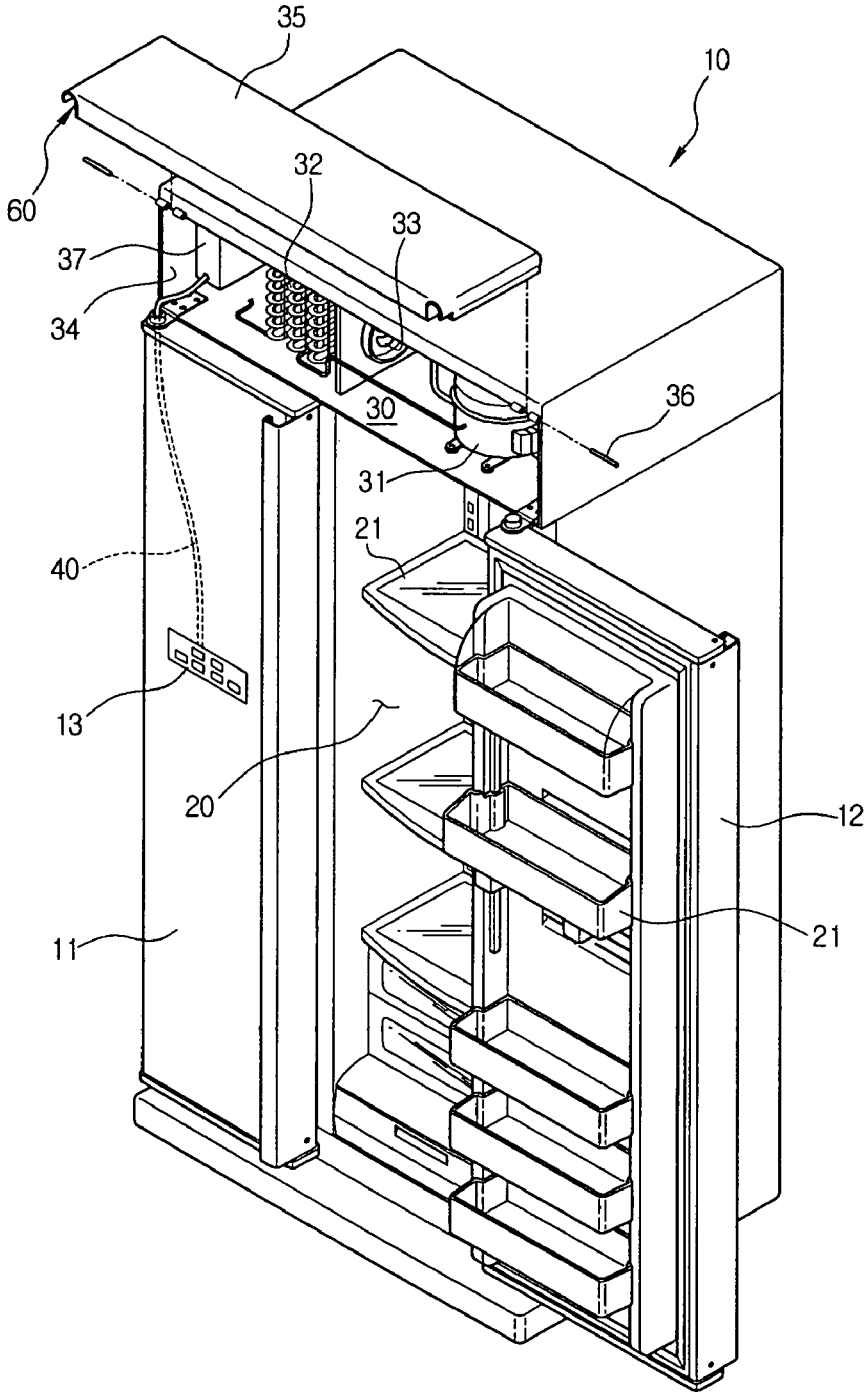
FIG. 1 is a perspective view of a general configuration of a refrigerator consistent with an exemplary embodiment of the present invention, in which a machinery chamber door is separated from a machinery chamber.

Reference will now be made in detail to the exemplary embodiments of the present invention, examples of which are illustrated in the accompanying drawings, wherein like reference numerals refer to like elements throughout. The exemplary embodiments are described below to explain the present invention by referring to the figures.

A refrigerator consistent with an exemplary embodiment of the present invention is adapted to store various foods in a fresh state for a long time in a storage chamber by supplying cold air generated from an evaporator of a cooling cycle to the storage chamber. As shown in FIG. 1, the refrigerator has an outer appearance defined by a body 10, which has an inner space partitioned to define a storage chamber 20 for storing foods at a lower portion of the body 10, and a machinery chamber 30 at an upper portion of the body 10.

The storage chamber 20 is provided at the rear side thereof with an evaporator (not shown). The machinery chamber 30 is provided with a compressor 31 for compressing refrigerant and supplying the compressed refrigerant to the evaporator, a condenser 32 between the compressor 31 and the evaporator for condensing the compressed refrigerant, and a cooling fan 33 between the compressor 31 and the condenser 32 for cooling the compressor 31 and the condenser 32 using ambient air.

The storage chamber 20 is partitioned into a left side freezing compartment and a right side refrigerating compartment. The body 10 is equipped at the front thereof with doors 11 and 12 for opening or closing the freezing and refrigerating compartments, respectively, such that the doors 11 and 12 can be hingably coupled to the body 10 to rotate right and left in order to open or close the freezing and refrigerating compartments, respectively. The machinery chamber 30 is formed at the front thereof with an opening portion 34, and is equipped with a machinery chamber door 35 hingably coupled to the opening portion 34 for opening and closing the machinery chamber 30, such that the machinery chamber door 35 can be rotated up and down. Reference numeral 21 denotes multi-stepped shelves equipped in the storage chamber 20 and at the rear side of the doors 11 and 12 to support the foods. Reference numeral 36 denotes a hinge pin, with which the machinery chamber door 35 can be hinged to the opening portion 34 of the machinery chamber 30.

Further, the door 11 at the freezing compartment side is provided at the front thereof with an operating panel 13 for overall operation of the refrigerator. The machinery chamber 30 is provided at one side therein with a control box 37 encasing a microprocessor for performing general control of the refrigerator using signals input through the operating panel 13.

When various driving conditions are input through the operating panel 13, to the control box 37 with the above structure, to drive the refrigerator, the control box 37 delivers commands corresponding to the input signal to respective components of the refrigerator, allowing the operation chosen by the user to be performed. Thus, an electric wire 40 comprising a signal line or a power line for supplying a predetermined signal or power is connected between the operating panel 13 and the control box 37, such that the electric wire 40 extends from the inside of the door 11 of the refrigerator through the upper end of the door 11 and the opening portion 34 of the machinery chamber 30 to the inside of the machinery chamber 30.

The doors 11 and 12 are equipped at the upper and lower ends thereof with hinge members for allowing the doors 11 and 12 to be hingably coupled to the front of the body 10, respectively, such that the doors 111 and 12 can be rotated. The electric wire 40 connecting the operating panel 13 and the control box 37 extends to the inside of the machinery chamber 30 through the hinge member provided at the upper end of the door 11 at the freezing compartment side. Thus, the hinge member at the upper end of the door 11 of the freezing compartment side has a structure for allowing the electric wire 40 to pass therethrough.

Figure 2:
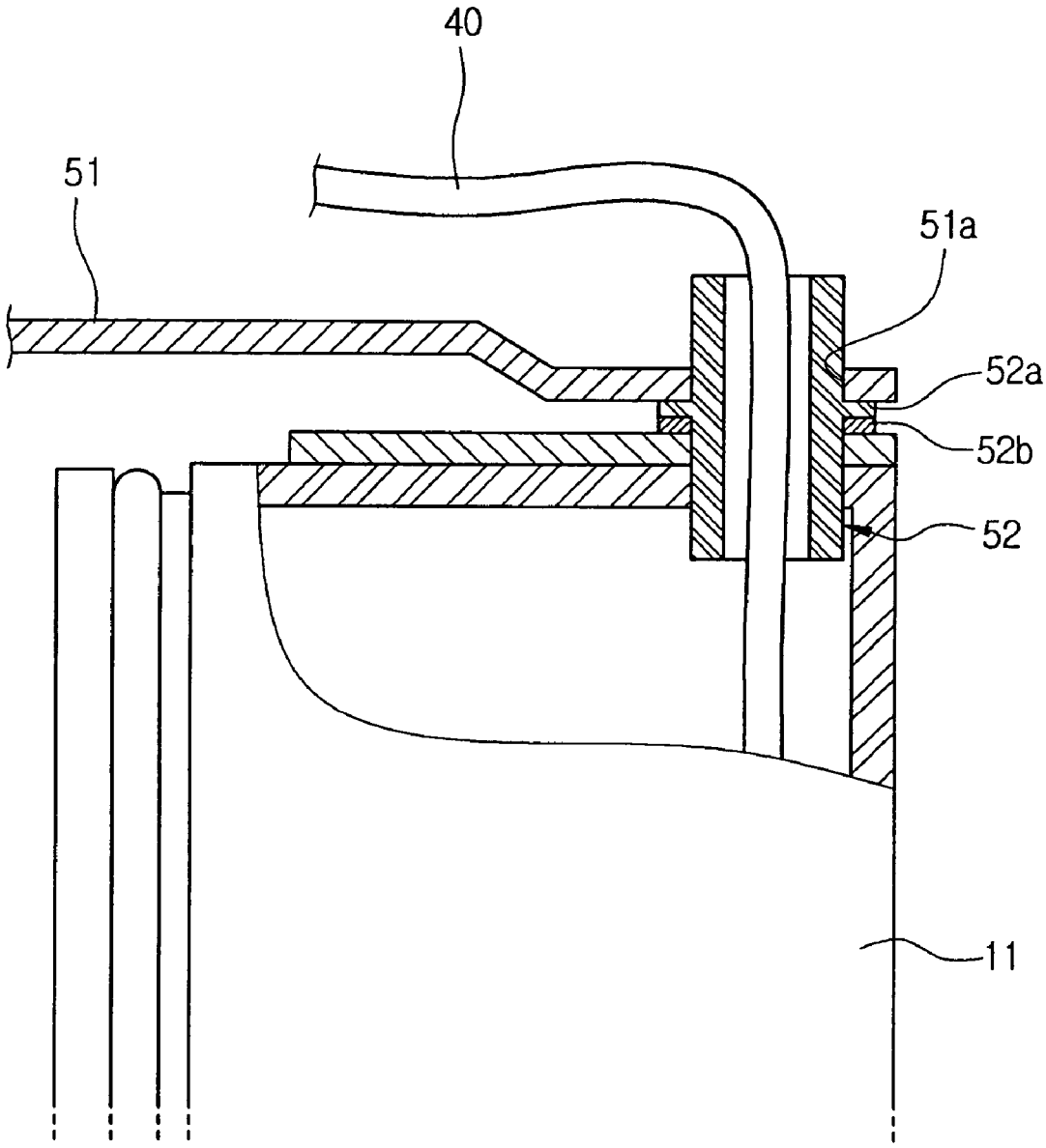
FIG. 2 is a cross sectional view illustrating a configuration of a hinge device provided at the upper end of a door at a freezing compartment of the refrigerator consistent with an exemplary embodiment of the present invention.

That is, as shown in FIG. 2, the hinge member provided at the upper end of the door 11 of the freezing compartment side is fixed to the body 10 at one end of the hinge member. At the other end of the hinge member, the hinge member extends to the door, and is provided with a hinge bracket 51 having a hinge hole 51*a* formed therein, and a hinge shaft member 52 engaged with the door 11 such that the hinge shaft member 52 is rotatably fitted into the hinge hole 51*a* of the hinge bracket 51. The electric wire 40 extends to the upper end of the door 11 through the hinge shaft member 52 and then leads to the inside of the machinery chamber 30 through the opening portion 34 of the machinery chamber 30. Thus, the hinge shaft member 52 has a hollow shape such that the electric wire 40 can pass through the hinge shaft member 52, and thus the upper end of the electric wire can be positioned in front of the opening portion 34 of the machinery chamber 30. Reference numeral 52*a* denotes a flange formed on an outer surface of the hinge shaft member 52 such that the hinge shaft member 52 can be clamped to the hinge hole 51*a* of the hinge bracket 51. Reference numeral 52*b* denotes a bush for rotatably supporting the hinge shaft member 52 between the flange 52*a* and the door 11.

Meanwhile, as described above, since the electric wire 40 extends to the inside of the door 11 through the opening portion 34 of the machinery chamber 30, the electric wire 40 is positioned in the rotating trace of the machinery chamber door 35 when opening or closing the machinery chamber door 35. Accordingly, the electric wire 40 can be damaged by opening or closing the machinery chamber door 35 or can interfere with opening or closing of the machinery chamber door 35. Thus, in order to prevent this, the refrigerator consistent with an exemplary embodiment of the present invention comprises an electric wire avoidance structure for allowing the machinery chamber door 35 to be smoothly opened or closed.

Figure 3:
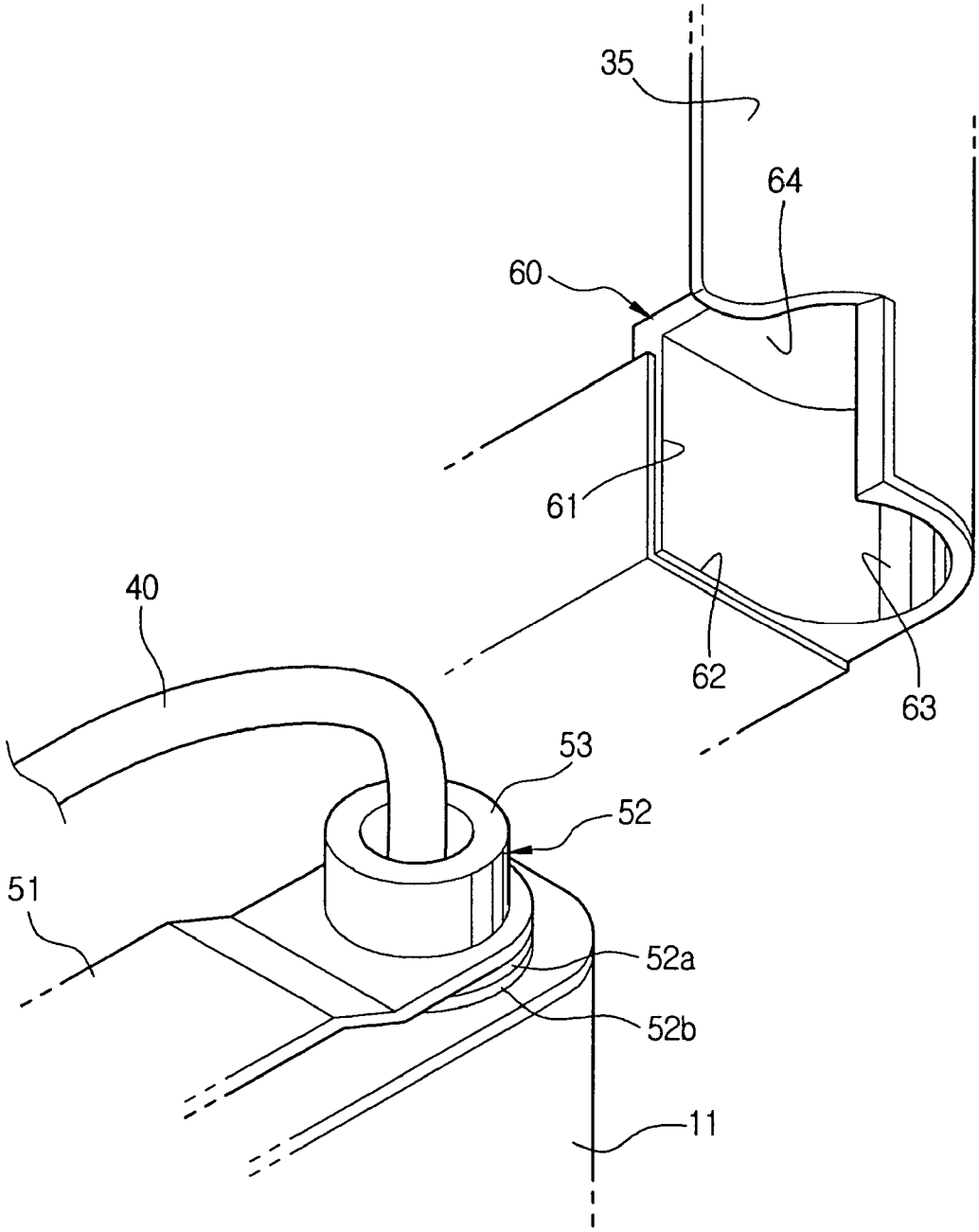
FIG. 3 is an enlarged perspective view illustrating a recess member and an insertion member of the refrigerator consistent with an exemplary embodiment of the present invention.

The electric wire avoidance structure of the refrigerator consistent with an exemplary embodiment of the present invention comprises, as shown in FIG. 3, an insertion member 53 provided at the opening portion 34 such that the insertion member 53 can hold the machinery chamber door 35 rotated to the opening portion 34, and a recess member 60 provided on the machinery chamber door 35 such that the recess member 60 can be engaged or disengaged to the insertion member 53, when the machinery chamber door 35 is forced to the opening portion 34 or to the opposite side of the opening portion 34.

Meanwhile, since the machinery chamber door 35 for opening or closing the machinery chamber 30 is hingably coupled to the opening portion 34 at the upper end of the machinery chamber door 35, the machinery chamber door 35 opens or closes the machinery chamber 30 when rotating the machinery chamber door 35 up and down. Thus, the machinery chamber door 35 will not cause noise unintentionally due to an impact applied when transporting the body 10 or due to a vibration generated when driving the compressor 31, etc. Thus, the combined structure of the insertion member 53 and the recess member 60 acts as a locking member for preventing the machinery chamber door 35 from being opened, when necessary, thereby avoiding the noise.

The insertion member 53 is defined by means of the upper end of the hinge shaft member 52 coupled to the upper end of the door 11 at the freezing compartment side. As a result, without separately manufacturing the insertion member 53, the locking member can be constituted simply by the recess member 60 and the insertion member 53 defined by means of the upper end of the hinge shaft member 52. That is, since the upper end of the hinge shaft member 52 coupled to the upper end of the door 11 of the freezing compartment side is positioned in front of the opening portion 34 of the machinery chamber 30, when the machinery chamber door 35 is closed, the upper end of the hinge shaft member 52 constitutes the insertion member 53 for supporting the rear side of the machinery chamber door 35, and the recess member 60 is coupled to a lower end edge at the rear side of the machinery chamber door 35 at a position corresponding to that of the insertion member 53.

More specifically, the insertion member 53 defining the upper end of the hinge shaft member 52 has an outer surface with a circular cross sectional shape. The recess member 60 has a barrel-shaped opening therein such that the lower end of the recess member 60 can pass through one side of the insertion member 53 for fitting the recess member 60 onto the insertion member 53. The recess member 60 has an inner surface adapted such that, with the recess member 60 fitted onto the insertion member 53, the recess member 60 can hold the insertion member 53 while surrounding at least half of the outer surface of the insertion member 53 in the circumferential direction. For this purpose, the recess member 60 has a side opening portion 61 defined at one side of the recess member 60 to which the insertion member 60 is inserted, and a lower end opening portion 62 defined at a lower end of the recess member 60, such that the side opening portion 61 and the lower end opening portion 62 communicate with each other. Further, the recess member 60 is provided at the inner surface thereof with a close contact portion 63 formed such that the recess member 60 can contact the outer surface of the insertion member 53 to hold the insertion member 53 while surrounding at least half of the outer surface of the insertion member 53 in the circumferential direction.

Figure 4:
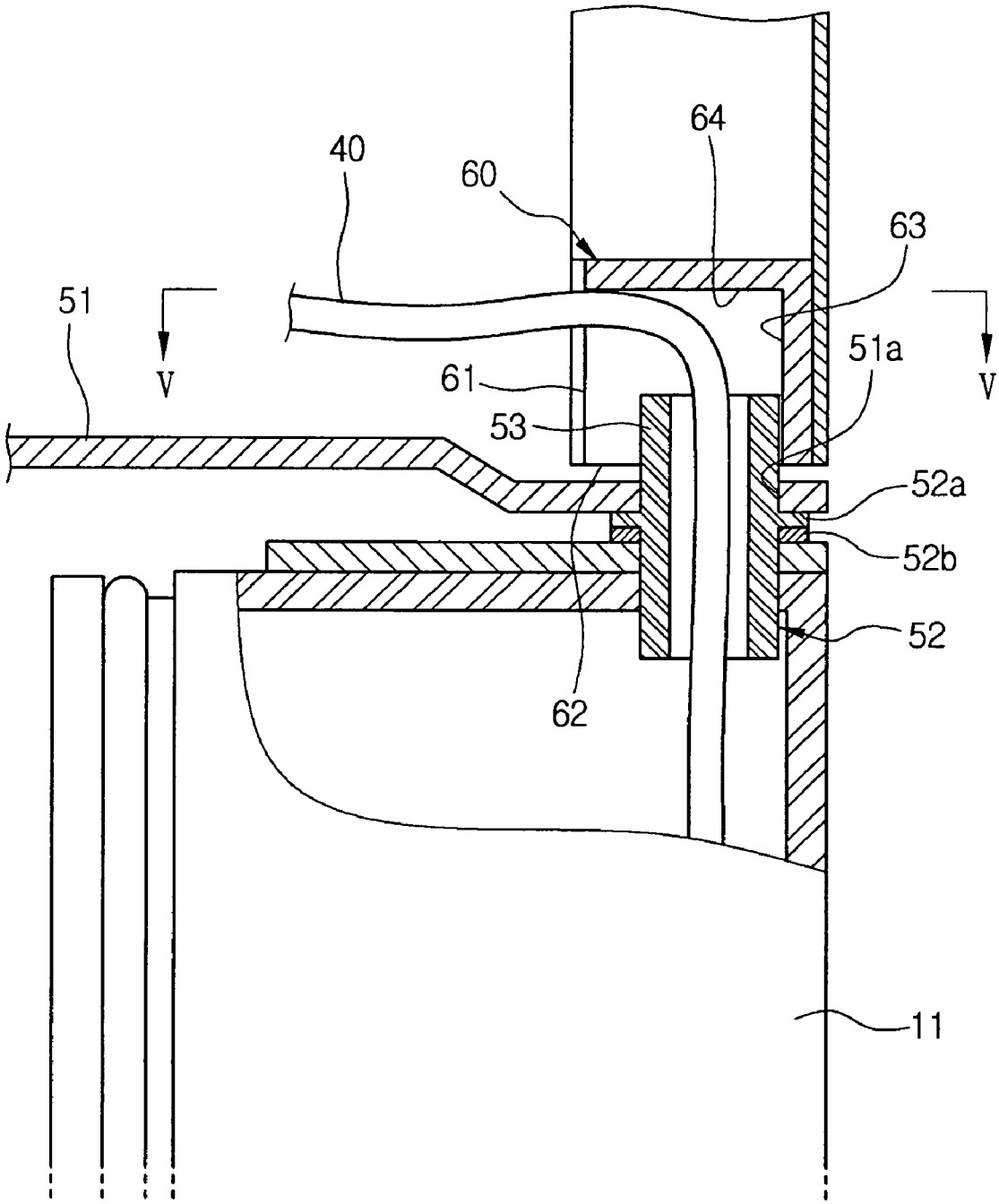
FIG. 4 is a sectional side elevation illustrating a configuration of the hinge device in a closed stated of the machinery chamber door in the refrigerator consistent with an exemplary embodiment of the present invention.
Figure 5:
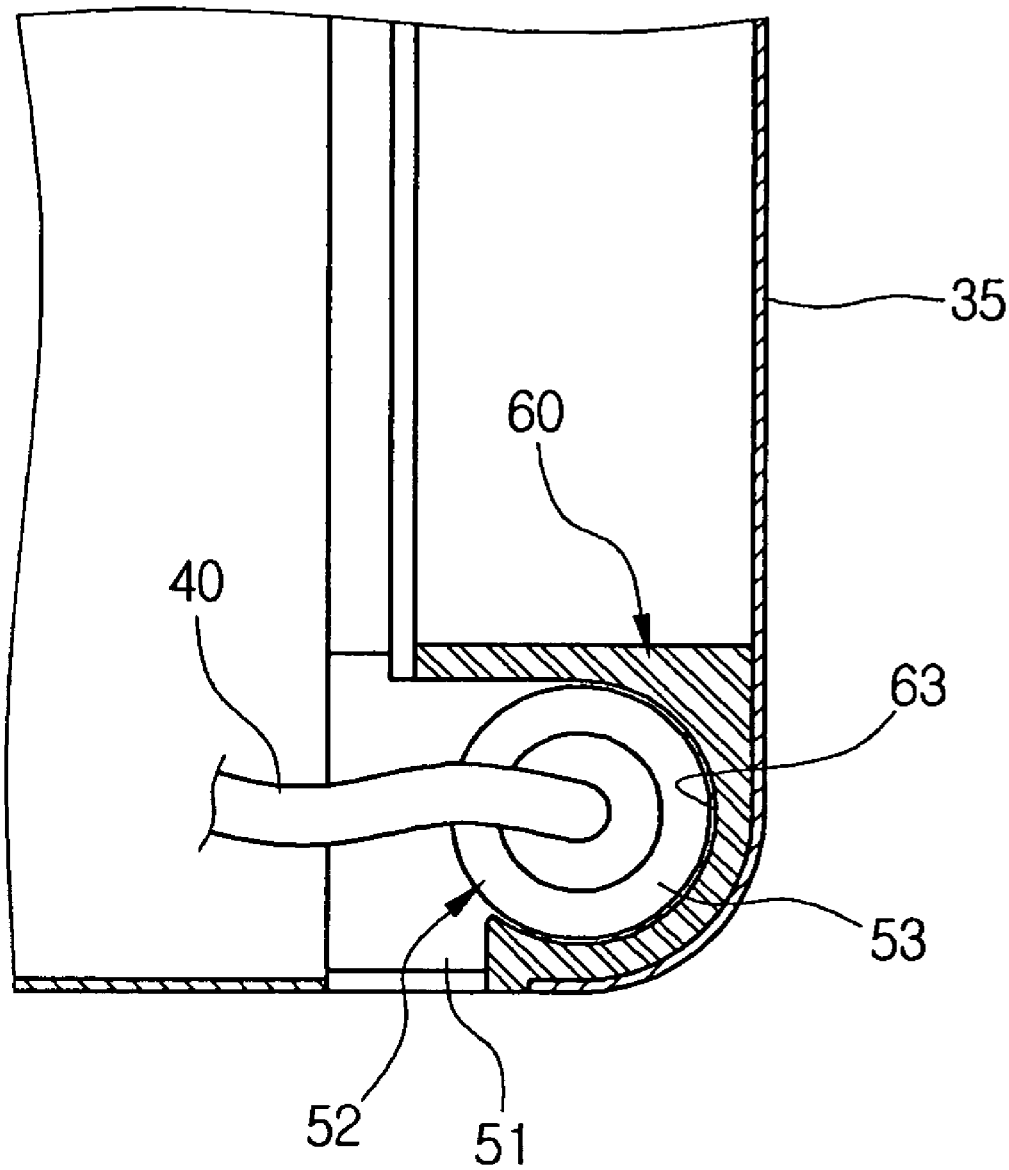
FIG. 5 is a cross sectional view of a portion, seen in the direction of the arrow after being taken along line V-V of FIG. 4.

In a state wherein the machinery chamber door 35 is rotated toward the opening portion 34 of the machinery chamber 30 with the above structure, when the machinery chamber door 35 is forced to the opening portion 34 of the machinery chamber 30, as shown in FIGS. 4 and 5, the side opening portion 61 of the recess member 60 is widened so that the inner surface of the recess member 60 can be engaged with the outer surface of the insertion member 53. After the recess member 60 is engaged with the outer surface of the insertion member 53, the widened side opening portion 61 is narrowed to an initial state, and the close contact portion 63 of the recess member 60 holds the insertion member 53 while surrounding the outer surface of the insertion member 53, so that the recess member 60 can be securely engaged with the insertion member 53 to maintain a locked state of the machinery chamber door 35.

When the machinery chamber door 35 is forced to the opposite side of the opening portion 34 in a state that the recess member 60 is engaged with the insertion member 53, the side opening portion 61 of the recess member 60 is widened again, so that the recess member 60 is separated from the insertion member 53 to release the locked state of the machinery chamber door 35. At this time, the machinery chamber door 35 does not directly contact the electric wire 40, while the recess member 60 closely contacts the insertion member 53 in an engage state of the recess member 60 and the insertion member 53.

Further, in order to allow easy expansion and contraction of the side opening portion 61, the recess member 60 is preferably made of an elastic material. Further, the recess member 60 is provided as an extrusion molded product, and fixed to the rear side of the machinery chamber door 35.

Additionally, the recess member 60 is provided at the upper end thereof with a closure 64 spaced from the insertion member 53 such that the closure 64 closes the upper end of the recess member 60. That is, the closure 64 is spaced from the upper end of the insertion member 53, defining a space having a predetermined height such that the electric wire 40 is allowed to pass through the space. Thus, the electric wire 40 can be easily guided to the inside of the machinery chamber 30 in a state that the electric wire 40 extending from the upper end of the insertion member 53 does not interfere with the machinery chamber door 35.

Figure 6:
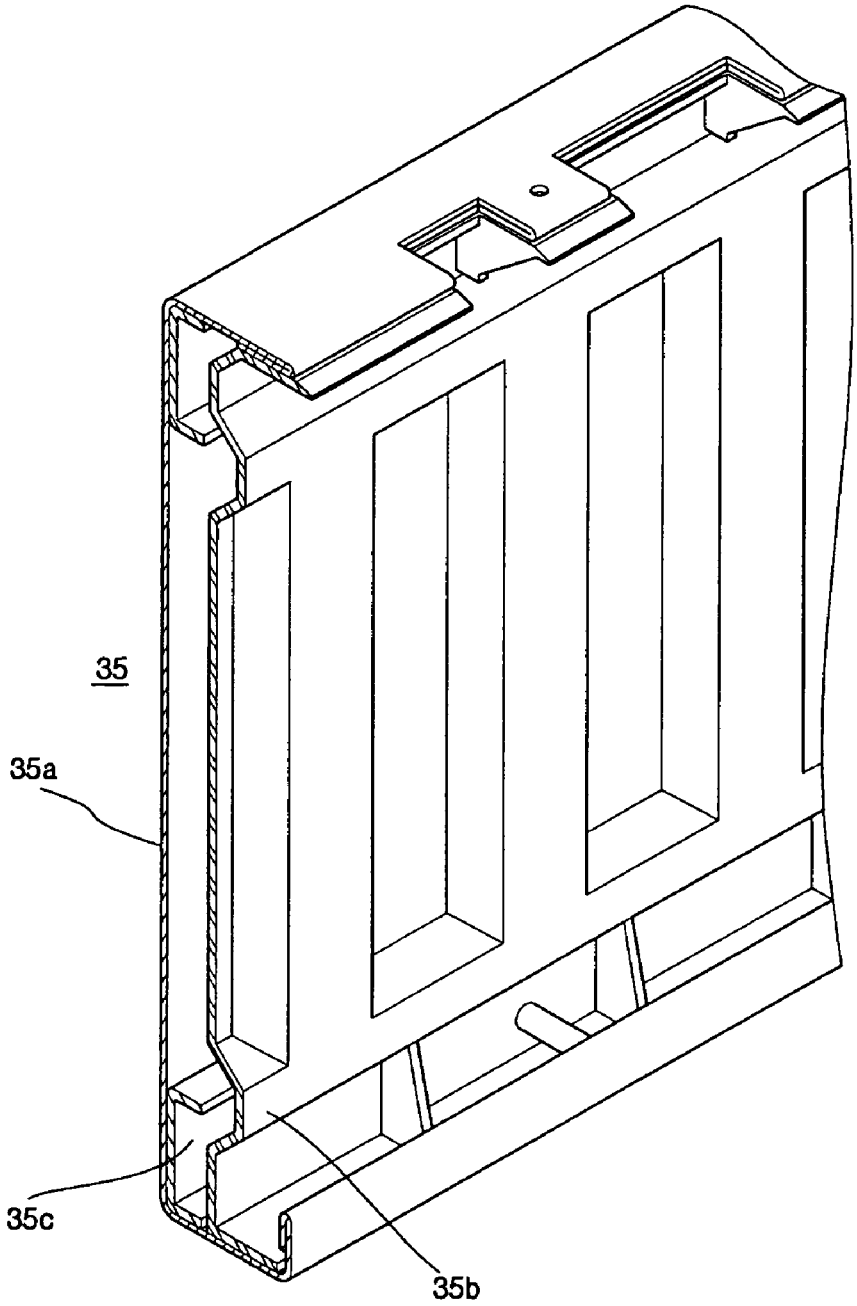
FIG. 6 is a sectional perspective view illustrating the rear side of the machinery chamber door of the refrigerator consistent with an exemplary embodiment of the present invention.

Meanwhile, as shown in FIG. 6, the machinery chamber door 35 consistent with an exemplary embodiment of the present invention comprises: a front panel 35*a*, which is manufactured by means of pressing a thin stainless steel plate, to be exposed to the outside when closing the machinery chamber door 35; a rear panel 35*b* coupled at the rear side of the front panel 35*a* to the front panel 35*a*; and a reinforcing member 35*c* between the front panel 35*a* and the rear panel 35*b*. The reinforcing member 35*c* is horizontally formed in the lengthwise direction along an edge of the machinery chamber door 35, thereby preventing the edge of the front panel 35*a* from being deformed by the impact from the outside.

Operation of the refrigerator consistent with an exemplary embodiment of the present invention and the advantageous effects thereof will now be described.

First, in a state wherein, with the machinery chamber door 35 rotated toward the opening portion 34 of the machinery chamber 30, the side opening portion 61 of the recess member 60 is held by the insertion member 53, when the machinery chamber door 35 is forced to the opening portion 34, the side opening portion 61 of the recess member 60 is widened, and the recess member 60 is fitted to the outer surface of the insertion member 53. After the recess member 60 is fitted to the insertion member 53, the side opening portion 61 widened to a predetermined extent is narrowed to the initial state, and the recess member 60 is securely fitted to outer surface of the insertion member 53.

Thus, in this state, the recess member 60 is prevented from deviating from the insertion member 53, whereby the machinery chamber door 35 is not opened or closed unintentionally by the impact applied when transporting the body 10 or by the vibration attributed to driving of the compressor 31, etc. Thus, the noise caused by the opening or closing of the machinery chamber door 35 does not occur. Further, when opening the machinery chamber door 35, the machinery chamber door 35 is forced to the opposite side of the opening portion 34, causing the side opening portion 61 of the recess member 60 to be widened, the recess member 60 is separated from the insertion member 53, thereby opening the machinery chamber door 35.

As is apparent from the above description, the refrigerator consistent with an exemplary embodiment of the present invention has the electric wire avoidance structure, which prevents the machinery chamber door from interfering with the electric wire extending from the inside of the machinery chamber to the inside of the door, thereby preventing the electric wire from being damaged, and allowing free rotation of the machinery chamber door.

Further, the refrigerator consistent with an exemplary embodiment of the present invention has the insertion member and the recess member detachably engaged with the insertion member, which acts as the locking member, so that the machinery chamber door is prevented from being opened or closed unintentionally by the impact applied when transporting the body 10 or by the vibration attributed to driving of the compressor 31, etc., thereby preventing the noise caused by opening or closing the door.

Further, without being separately manufactured, the insertion member constituting the locking member is provided by means of the upper end of the hinge shaft member coupled to the upper end of the door such that the electric wire can be guided between the operation panel and the machinery chamber, thereby simplifying the structure of the locking device as described above.

Although a few exemplary embodiments of the present invention have been shown and described, it would be appreciated by those skilled in the art that changes may be made in the exemplary embodiments without departing from the principles and spirit of the invention, the scope of which is defined in the claims and their equivalents.

What is claimed is:

1. A refrigerator comprising:

a body with a storage chamber, and with a machinery chamber provided at an upper portion of the body such that the machinery chamber is partitioned from the storage chamber;

an opening portion provided at one side of the machinery chamber;

a machinery chamber door hingably coupled to the opening portion such that the machinery chamber door can be rotated up and down to open or close the machinery chamber;

an insertion member fixed to the body, and a recess member provided on the machinery chamber door and made of an elastic material to be detachably engaged to the insertion member.

2. The refrigerator according to claim 1, wherein the recess member and the insertion member act as a locking device provided for preventing the machinery chamber from being opened.

3. The refrigerator according to claim 2, wherein the insertion member is provided to support the machinery chamber door rotated toward the opening portion, and the recess member is provided at the machinery chamber door such that the recess member is detachably engaged to the insertion member by pressing the machinery chamber door to the opening portion or to an opposite side of the opening portion.

4. The refrigerator according to claim 3, further comprising:

a door hingably coupled at a front side of the storage chamber to the body such that the door can be rotated right and left to open or close the storage chamber;

an operating panel and a control box provided on an outer surface of the door and inside of the machinery chamber, respectively;

an electric wire connected between the operating panel and the control box such that the an electric wire can extend from inside of the door through an upper end of the door to the inside of the machinery chamber; and a hollow rod-shaped hinge shaft member joined to the upper end of the door while being provided such that the hinge shaft member is rotatably fitted in a hinge hole of a hinge bracket coupled to the body and the electric wire can be passed through the hinge shaft member;

wherein the opening portion is situated at a front side of the machinery chamber, and the insertion member comprises an upper end of the hinge shaft member.

5. The refrigerator according to claim 4, wherein the insertion member has a circular cross-sectional shape, and the recess member has a barrel-shaped opening such that a lower end of the recess member can pass through one side of the insertion member for fitting the recess member to the insertion member via the one side of the insertion member, while having an inner surface structured such that with the recess member fitted to the insertion member, the recess member can hold the insertion member while surrounding at least half of the outer surface of the insertion member in a circumferential direction.

6. The refrigerator according to claim 5, wherein the recess member has a side opening portion situated at one side of the recess member to which the insertion member is inserted, and a lower end opening portion situated at a lower end of the recess member, the recess member being made of an elastic material, and wherein the side opening portion is widened while the insertion member is engaged to or disengaged from the recess member, and is then narrowed to an initial state after the insertion member is engaged to or disengaged from the recess member.

7. The refrigerator according to claim 5, wherein the recess member is extrusion molded, and fixed to a rear side of the machinery chamber door at a position corresponding to a position of the insertion member.

8. The refrigerator according to claim 5, wherein the recess member has an upper end closed and spaced apart from an upper end of the insertion member.

9. A refrigerator comprising:

a body with a storage chamber, and with a machinery chamber having an opening portion formed at one side of the machinery chamber;

a door, equipped with an electrical component chamber, for opening or closing the storage chamber;

an electric wire extending from the inside of the machinery chamber to the electrical component chamber through the opening portion of the machinery chamber; and a machinery chamber door with an electric wire avoidance portion comprising a recess member for preventing interference with the electric wire and an insertion member fitted to the recess member, such that the machinery chamber door opens and closes the opening portion of the machinery chamber.

10. The refrigerator according to claim 9, wherein the door is hingably coupled to the body by a hinge part, and the electric wire is fixed by the hinge part.

11. The refrigerator according to claim 10, wherein the hinge part comprises a hollow hinge shaft member such that the electric wire passes through the hinge shaft member.

12. The refrigerator according to claim 11, further comprising: an electric wire protection member closely contacting while surrounding the electric wire avoidance portion when the machinery chamber door is closed.

13. The refrigerator according to claim 9, further comprising: a control box provided in the machinery chamber, and electrically connected to the electrical component chamber by the electric wire.

14. The refrigerator according to claim 9, further comprising: an operating panel provided in the door, and electrically connected to the electrical component chamber in order to receive an operating signal input by a user.

15. The refrigerator according to claim 9, further comprising: a front panel made of stainless steel; a rear panel coupled to the front panel; and a reinforcing member provided between the front panel and the rear panel for preventing the front panel from being deformed.

* * * * *